US008826817B2

(12) United States Patent
Block et al.

(10) Patent No.: US 8,826,817 B2
(45) Date of Patent: Sep. 9, 2014

(54) DIE CUTTING SYSTEM WITH ADDED CAPABILITIES

(75) Inventors: Andrew P. Block, Middleton, WI (US); Scott Roelke, Arena, WI (US); Lisa Painter, Madison, WI (US)

(73) Assignee: Fiskars Brands, Inc., Madison, WI (US)

( * ) Notice: Subject to any disclaimer, the term of this patent is extended or adjusted under 35 U.S.C. 154(b) by 413 days.

(21) Appl. No.: 13/192,265

(22) Filed: Jul. 27, 2011

(65) Prior Publication Data

US 2013/0025424 A1 Jan. 31, 2013

(51) Int. Cl.

| | |
|---|---|
| ***B44B 5/02*** | (2006.01) |
| ***B26F 1/44*** | (2006.01) |
| ***B44B 5/00*** | (2006.01) |
| *B26F 1/40* | (2006.01) |

(52) U.S. Cl.

CPC ..... *B44B 5/0019* (2013.01); *B26F 1/44* (2013.01); *B26F 1/40* (2013.01)

USPC ..... 101/28; 101/30

(58) Field of Classification Search

USPC ..... 101/22, 23, 28

See application file for complete search history.

(56) References Cited

U.S. PATENT DOCUMENTS

| | | | | |
|---|---|---|---|---|
| 4,594,927 | A | 6/1986 | Mori | |
| D373,385 | S | 9/1996 | Birkholz | |
| 5,582,102 | A * | 12/1996 | Holliday | 101/28 |
| 5,601,006 | A | 2/1997 | Quinn et al. | |
| 5,722,319 | A * | 3/1998 | Hirano | 101/23 |
| D393,657 | S | 4/1998 | Bennett | |
| D407,752 | S | 4/1999 | Kim et al. | |
| D419,178 | S | 1/2000 | Kim et al. | |
| 6,209,434 | B1 | 4/2001 | Kim et al. | |
| 6,626,965 | B2 | 9/2003 | Workman et al. | |
| 6,739,244 | B1 * | 5/2004 | Carbaugh | 101/3.1 |
| D508,701 | S | 8/2005 | Corcoran et al. | |
| 7,011,009 | B1 | 3/2006 | Tomich | |
| 7,104,192 | B1 * | 9/2006 | Corcoran | 101/23 |

(Continued)

FOREIGN PATENT DOCUMENTS

| | | |
|---|---|---|
| EP | 1741526 | 1/2007 |
| EP | 1 457 297 B1 | 8/2007 |

OTHER PUBLICATIONS

European Search Report for European Patent Application No. 12004506.7, dated Nov. 29, 2012, 5 pages.

(Continued)

*Primary Examiner* — David Banh

(74) *Attorney, Agent, or Firm* — Foley & Lardner LLP

(57) ABSTRACT

A system for cutting, inking, and debossing sheet material located between a die and a cutting plate is provided. The system includes a die having a support defining an opening, a blade positioned adjacent to the support and defining a cutting edge, a debossing plate configured to cause one or more indentations in the sheet material and including a first side and a second side located substantially opposite the first side, the first side having a raised pattern defined thereon, and at least one pin configured to extend through the opening in the support and to move between a first position and a second position. When the at least one pin is in the first position, the debossing plate is supported by the support, and when the at least one pin is in the second position, the debossing plate is supported by the at least one pin.

21 Claims, 12 Drawing Sheets

(56) References Cited

U.S. PATENT DOCUMENTS

| | | | | |
|---|---|---|---|---|
| D540,374 | S | 4/2007 | Corcoran | |
| D542,310 | S | 5/2007 | Corcoran et al. | |
| D587,287 | S | 2/2009 | Corcoran et al. | |
| D607,910 | S | 1/2010 | Corcoran et al. | |
| D632,317 | S | 2/2011 | Corcoran et al. | |
| 8,127,651 | B2 * | 3/2012 | Henkemeyer et al. | 83/691 |
| 2003/0037657 | A1 | 2/2003 | Oh et al. | |
| 2003/0205122 | A1 | 11/2003 | Oh | |
| 2005/0211036 | A1 * | 9/2005 | Oh | 83/467.1 |
| 2005/0253324 | A1 | 11/2005 | Corcoran et al. | |
| 2006/0037503 | A1 | 2/2006 | Winston | |
| 2006/0196327 | A1 | 9/2006 | Larsen | |
| 2007/0272096 | A1 * | 11/2007 | Reijnen | 101/3.1 |
| 2008/0264284 | A1 * | 10/2008 | Hutchison et al. | 101/389.1 |
| 2011/0252939 | A1 | 10/2011 | Nabity et al. | |
| 2011/0303105 | A1 * | 12/2011 | Dywan | 101/26 |

OTHER PUBLICATIONS

U.S. Appl. No. 29/404,451, filed Oct. 20, 2011, Michael D. Wallom.
U.S. Appl. No. 29/401,055, filed Sep. 6, 2011, Andrew P. Block.
Fiskars School Office Craft Products 2005 catalog, pp. 71-73.
Fiskars Craft Products 2007 catalog, pp. 42-47 and 70-83.
European Search Report for European Patent Application No. 12007902.5 Issued Apr. 12, 2013, 5 pages.

* cited by examiner

DIE CUTTING SYSTEM WITH ADDED CAPABILITIES

BACKGROUND

The present disclosure relates generally to the field of cutting dies. The present disclosure relates more specifically to the field of cutting dies capable of simultaneously cutting and inking sheet material.

In scrapbooking and paper craft arts, hobbyists form objects of various shapes from sheet materials, such as craft paper. The hobbyist may use scissors or dies to cut various shapes. The hobbyist may further apply ink to provide desired colors and press embossed (raised in relief) or debossed (indented into a surface) patterns to these cut shapes. However, each separate process is time consuming, and the multiple steps of the process make reproducing the finished product difficult.

SUMMARY

One embodiment relates to a system for cutting, inking, and debossing sheet material located between a die and a cutting plate. The system includes a die having a support defining an opening, a blade positioned adjacent to the support and defining a cutting edge, a debossing plate configured to cause one or more indentations in the sheet material and including a first side and a second side located substantially opposite the first side, the first side having a raised pattern defined thereon, and at least one pin configured to extend through the opening in the support and to move between a first position and a second position. When the at least one pin is in the first position, the debossing plate is supported by the support, and when the at least one pin is in the second position, the debossing plate is supported by the at least one pin.

Another embodiment relates to a die for cutting and debossing sheet material. The die includes a first support including an upper surface and defining an opening extending through the first support, a debossing plate configured to cause one or more indentations in the sheet material and comprising a first side having a raised pattern defined thereon and a second side located substantially opposite the first side, the second side positioned adjacent the upper surface of the first support, a blade coupled to the first support and defining a cutting edge, and a pin including a first end and a second end, the first end extending at least partially through the opening defined in the first support. The pin is configured to move between a first pin position and a second pin position. When the pin is in the first pin position, the first end of the pin is below the upper surface of the first support, and when the pin is in the second pin position the first end of the pin extends above the upper surface of the first support.

DETAILED DESCRIPTION

Figure 1:
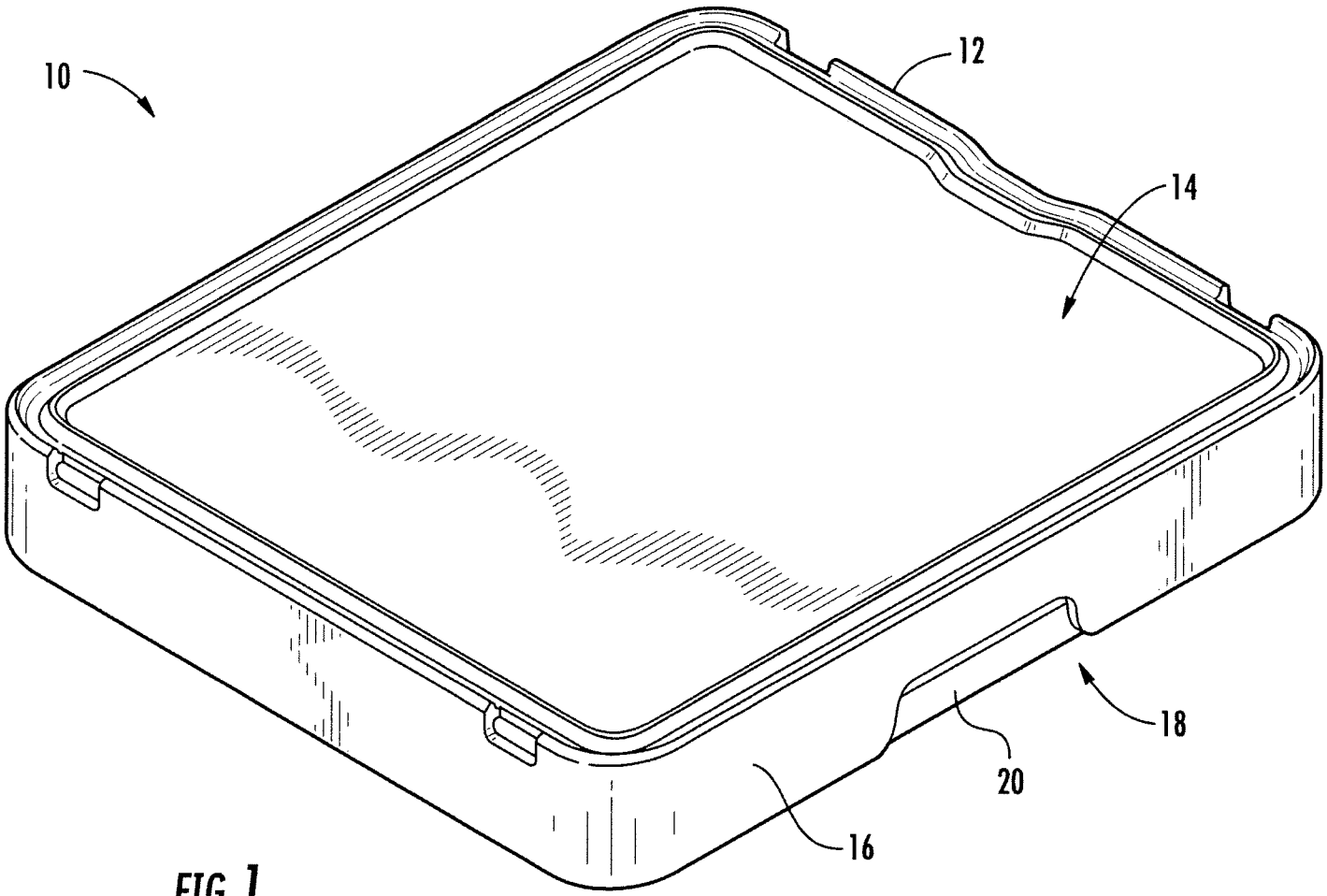
FIG. 1 is an isometric view of a die assembly with a cover, according to an exemplary embodiment.
Figure 2:
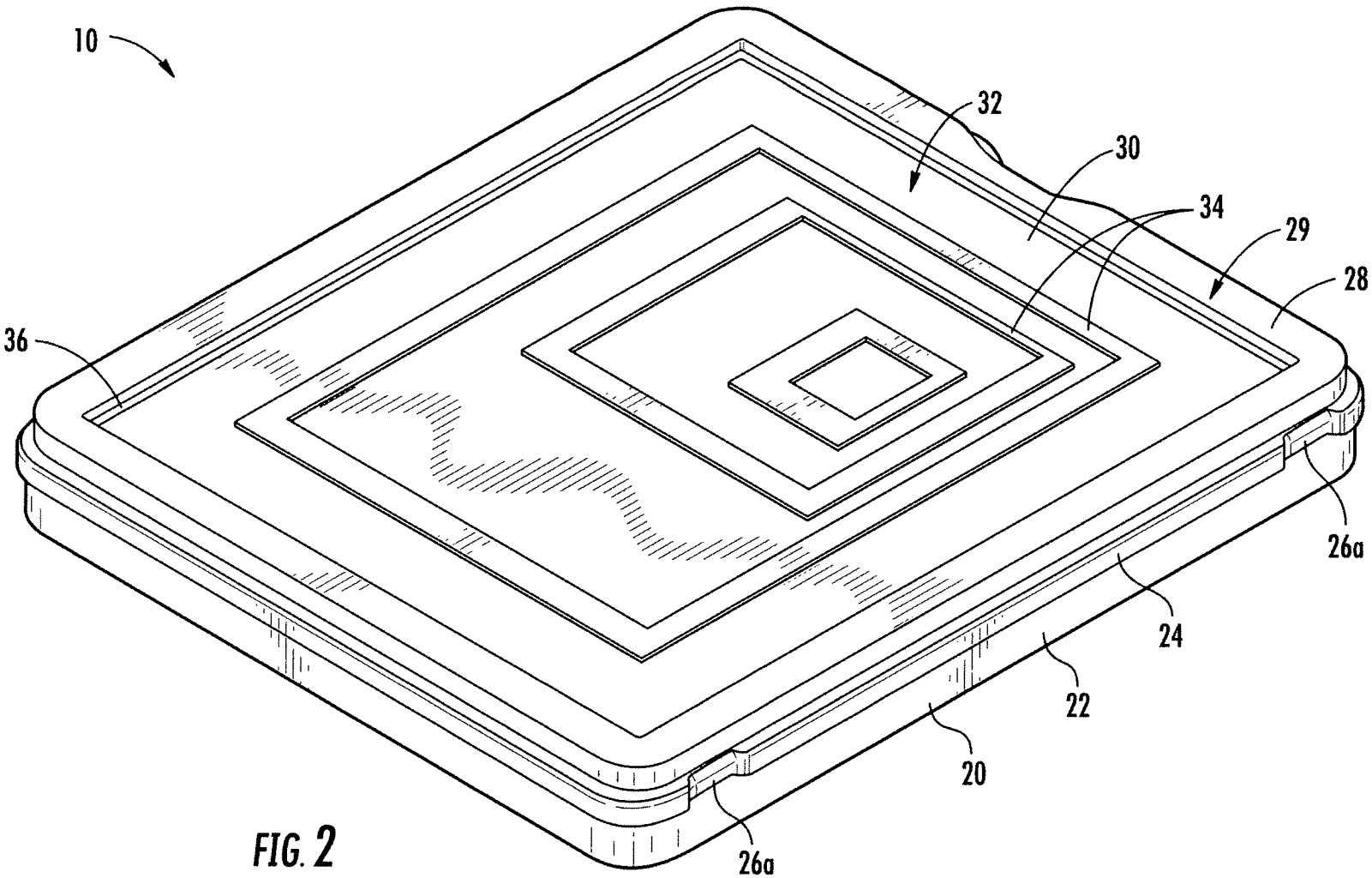
FIG. 2 is an isometric view of the die assembly of FIG. 1.

Referring generally to the Figures, a die cutting system with added capabilities, and components thereof, are shown according to various exemplary embodiments. The systems described are configured to, among other things, simultaneously cut and ink or cut, ink, and deboss sheets of craft paper, fabric, or other sheet materials. These systems reduce the number of steps required to create a pattern that contains an ink pattern, embossed or debossed patterns, and a cut pattern out of a larger sized sheet of craft material. Providing a system on an at-home consumer level that can simultaneously cut and deboss or cut, ink, and deboss sheet material removes the need to register the sheet material for the cutting process and then again register the cut pattern with the debossing and inking process. Removing the registration of these processes reduces user error. Further, enabling a user to apply ink without removing the inking and debossing dies results in a faster, cleaner, and more repeatable operation.

According to various embodiments, the systems generally include a die assembly used in combination with a press mechanism (e.g., a roller press, vertical press, etc.). The die assembly includes a cutting blade and a letter press plate (e.g., an inking plate, a debossing plate, ejection plate, etc.). After the letter press plates are inked (e.g., using a brayer, roller, or pad), a sheet of craft material is placed between the die and a cutting plate. The die, letter press plate, sheet material and cutting plate can be referred to as a stack or a sandwich. The overall thickness of the cutting plate and the die is larger than the distance between the rollers of the press, causing the blade edge of the die to press through the sheet material and into the cutting plate. In a debossing operation, the sacrificial cutting surface includes a resilient surface of a desired thickness and durometer, thereby allowing the debossed image to be pressed deeper into the sheet material while still cutting the entirety of the desired cutting pattern.

As shown in FIGS. 1-3 and 7-10, a cutting blade die may be formed using a steel rule die. A steel rule die for the consumer market may include four components: a rule, a substrate, a die carrier, and an ejection material. A thin blade, or rule, is placed in a substrate with a matching pattern to maintain the desired shape of the rule. The "steel" rule is typically steel, but may be made from any other suitable material. The steel rule is taller than the substrate, allowing the blade edge to extend above the upper surface of the substrate when the lower edge is roughly in plane with the bottom surface of the substrate. A layer of ejection material (e.g., a resilient material, a closed cell foam, etc.) may be attached to the upper surface of the substrate. The ejection material is taller than the protruding height of the steel rule and is adjacent to at least one side of the raised portion of the blade to help protect a user from the blade edge of the steel rule, as well as assist in the process of removing the sheet material after the cutting process has been completed. A die carrier may be added below the substrate to protect the rollers of the roller press from the lower edge of the steel rule if the substrate is not supporting the lower edge of the rule. This carrier also provides an aesthetic purpose by hiding the substrate, which is not always aesthetically pleasing.

The steel rule may be replaced by a different type of cutting blade, such as a chemically etched die (shown in the embodiments of FIGS. 4-6), or a flex die, which may be applied to the upper surface of the substrate with openings inside of the chemically etched die blade to allow the letter press plate to be nested within the cutting shape.

A letter press plate may be placed within the blade of the die. A mechanism may be included in the die to selectively raise the letter press plate above the ejection material, to allow ink to be applied to the plate without inking the blade or ejection material. The mechanism may include ejector pins that travel vertically within formed openings in the substrate. The travel of the ejector pins may be limited by an upper surface formed in the substrate and the upper surface of the die carrier that capture a larger diameter region of the ejector pins. As shown, when the pins are in their minimum height position, the upper face of the pin is lower than the upper surface of the substrate, allowing the letter press plate to rest flush with an upper surface of the substrate. When the pins are in their maximum height configuration, the upper surface contacts the letter press plate, lifting the letter press plate above the upper surface of the substrate. The height the letter press is lifted by the pins is sufficient to apply ink to the raised pattern of the letter press plate without applying ink to the ejection foam, but allowing the letter press plate to still register with the steel rule. The product packaging or a surface of the die cover may include structures configured to raise the pins from the minimum to maximum height positions.

Before discussing further details of the system and die, it should be noted that similarly numbered elements in various embodiments may have similar characteristics or function. For example, elements 40, 140, 240, 340, and 440 are all blades, but may be a steel rule or a chemically etched blade depending on the embodiment and, therefore, coupled to the support differently. Further, references to "upper," "lower," "top," "bottom," "inner," and "outer" in this description are merely used to identify the various elements as they are oriented in the Figures, with "upper," "lower," "top," "bottom," "inner," and "outer" being relative to a specific direction. These terms are not meant to limit the element which they describe, as the various elements may be oriented differently in various applications.

It should further be noted that for purposes of this disclosure, the term coupled refers to the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring generally to FIGS. 1, 2, 3A, and 4, a die assembly 10 is shown according to an exemplary embodiment. The die assembly 10 generally comprises a plate (e.g., inking plate, embossing plate, letter press plate, etc.), shown as a debossing plate 30, a blade (e.g., cutting element, steel rule, etc.) shown as a rule 36, and a first support, shown as an inner support 40.

A rule 36 is shown to be a thin blade having a first end, shown as a cutting edge 38, and a second end, shown as a bottom end 39. The rule 36 is typically made from steel and may substantially follow the perimeter of the inner support 40. However, the rule 36 may be made from any suitable material.

The inner support 40 is shown to include an upper surface 42, which forms a substantially smooth surface, having a plurality of openings 45 (e.g., holes, apertures, bores, etc.) configured to allow passage of the pins 60. A sidewall or a skirt 44 extends downwardly from an outer edge of the upper surface 42. A flange 46 (e.g., lip, protrusion, etc.) extends outwardly beyond the profile of the rule 36 from the skirt 44, the flange following substantially all of the perimeter of the inner support 40. An upper surface 48 of the flange 46 supports the lower end 39 of the rule 36 and may form a positive stop to the rule 36 during assembly.

The inner support 40 may include a plurality of webs (e.g., beams, spans, spars, etc.), shown as ribs 49, which are configured to provide adequate support for the debossing plate 30 and the rule 36 during the debossing and cutting processes. That is, the ribs 49 help prevent crushing or deformation of the inner support 40. The vertical orientation of the ribs 49 form cavities 47 configured to receive the ejector pins 60.

A third support, shown as an outer support 20, may include a first sidewall or outer web 22 and a second sidewall or inner web 23 joined by a flange 25. The outer support 20 substantially follows the perimeter of the rule 36. The outer support 20 may be configured such that the inner web 23 is supported by the flange 46 and forms a compression fit or press fit with the rule 36 and/or the sidewall 44 of the inner support 40, thereby retaining the rule 36 and preventing deformation of the rule 36 during the cutting process.

The outer support 20 is further shown to include an outwardly extending flange or lip 24. The lip 24 substantially follows the perimeter of the outer support 20, but may be discontinuous or only follow portions of the perimeter. For example, the lip 24 may include recesses or gaps 26*a* and 26*b*, which are asymmetrically located on opposite sides of outer support 20.

An ejection member 28 may be coupled to an upper surface of the flange 25 of the outer support 20 and include a layer of resilient material (e.g., closed cell foam, etc.). The ejection member 28 has an upper surface 29 that, in a relaxed state, is taller than the height of the rule 36. That is, the distance from the upper surface 29 to the upper surface 42 of the inner support 40 is greater than the distance from the cutting edge 38 of the rule 36 to the upper surface 42 of the inner support 40. Accordingly, the ejection member 28 helps protect a user from the cutting edge 38 of the rule 36. However, during the cutting process, the ejection member 28 compresses, thereby allowing the rule 28 to pass through the sheet material to the cutting plate. After the cutting process, the ejection member 28 returns to a relaxed state, raising the sheet material from the blade 38 and assisting in the process of removing the sheet material from the die assembly 10.

The die assembly 10 may further include a second support, shown as the base 50. The base 50 includes a bottom wall 53 having one or more openings 54 (e.g., holes, apertures, bores, etc.) extending at least partially through the bottom wall 53. The structures 52 extending upward or inward from the bottom wall 53 and may be coupled to, or formed as part of the bottom wall 53. The structures 52 are configured to limit radial movement of the pin 60 and help guide the pin 60 during longitudinal movement. The base 50 may further include a plurality of coupling elements, shown as the tabs 56, which are configured to extend between the inner web 23 and the outer web 24 of the outer support 20 and engage features therein, thereby coupling (e.g., snapping) the base 50 to the outer support 20.

The die assembly 10 may further include a debossing plate 30, which includes a first surface (e.g., first side, obverse, inking side, patterned side, etc.), shown as the top surface 32, and a second surface (e.g., second side, reverse, etc.), shown as the bottom surface 33. The top surface 32 may be a substantially smooth surface configured primarily for stamping ink onto the sheet material, or may have a raised pattern 34 configured to deboss a pattern into the sheet material. The raised pattern may be of any desired shape and may include portions of varying pattern depth. The debossing plate 30 has a thickness which is less than the distance from the cutting edge 38 of the rule 36 to the upper surface 42 of the inner support 40 and may be made out of steel or any other suitably rigid and durable material.

The rule 36 substantially surrounds a periphery of the debossing plate 30. As shown, the debossing plate 30 and the rule 36 slidingly fit; however, the rule 36 and the debossing plate 30 may be spaced apart. For example, a second ejection member may be located between the rule 36 and the debossing plate 30.

The die assembly 10 may further include one or more pins 60*a*-60*e* (e.g., studs, members, rods, ejector pins, etc.) (referred to generally as 60 herein). Each pin 60 includes a first end, shown as the plate end 62, and a second end, shown as the base end 64. The plate end 62 is configured to selectively extend through the opening 45 in the inner support 40, and the base end 64 is configured to at least partially extend through the opening 54 in the base 50. In a particular embodiment, a central most pin 60*a* is larger than the rest of the pins 60; however, any pin may be the same or differently sized than any other pin.

Each pin 60 is further shown to include a flange 66 extending radially outwardly from a middle portion of the pin 60. The flange 66 may or may not be round; however, the diameter is greater than the diameters of the openings 45 in the inner support 40 and the openings 54 in the base 50. Accordingly, the pin 60 is retained between the inner support 40 and the base 50. The thickness and location of the flange 66 along the pin 60 may be selected to define desired limits of travel to the pin 60. According to various alternate embodiments, the pin 60 may include a plurality of longitudinally spaced flanges, the flanges being within the inner support 40 and the base 50, outside the inner support 40 and the base 50, or a combination thereof.

According to the exemplary embodiment, the length of the pin 60 is less than the distance from the upper surface 42 of the inner support 40 to the bottom of the die assembly 10. Accordingly, when the die assembly 10 is placed on a flat surface, e.g., in a press, the pins 60 are lower than the upper surface 42, thereby permitting the debossing plate 30 to be supported by the inner support 40. Alternatively, the debossing plate 30 may include a recess which would enable the pin 60 to stand proud of the upper surface 42 while allowing the debossing plate 30 to be supported by the inner support 40.

The pin 60*a* may include a magnet 68 configured to retain the debossing plate 30 to the die assembly 10. For example, some inks may be sufficiently sticky as to otherwise lift the debossing plate 30 from the die assembly 10 during the inking process. The debossing plate 30 and the other pins 60 may also include magnets, thereby enabling orientation of the debossing plate 30 relative to the die assembly 10 and/or the rule 36. According to various embodiments, the pins 60 and/or the debossing plate 30 may be formed of plastic, metal, or other suitable material or materials and may be formed of or include a magnetic material.

According to one alternate embodiment, each pin 60 may be coupled to the bottom surface 33 of the debossing plate 30. According to another alternative embodiment, the pin 60 may have other shapes (i.e., may not be longitudinally elongate), for example, forming a plate, a ring, a stencil of the debossing plate shape, otherwise following a contour of the debossing plate, etc.

The locations of the pins 60 and the openings 45 and 54 may be selected to facilitate operation with a plurality of debossing plate shapes, thereby enabling a user to remove the debossing plate 30 and replace it with another debossing plate. The debossing plate 30 may be replaced by a different size or shape debossing plate that would fit within the rule 36. Additional ejection material and/or a low-profile insert may be used to retain and orient the replacement debossing plate within the rule 36.

The system may include a cover 12 (e.g., lid, top, protective cover, attachment, etc.) having an outer surface 14 and an inner surface 15. A sidewall 16 extends downward from the outer surface 14 and may include an opening or recess 18 configured to allow a user to grasp the outer support 20 to facilitate separating the cover 12 from the die. The cover 12 may move between a first cover position (e.g., closed, sealed, storage position, etc.), shown in FIGS. 1 and 3A, and a second cover position (e.g., open, inverted, inking position, etc.), shown in FIGS. 8 and 9. The closed position facilitates storage and handling of die without inadvertently transferring ink.

Figure 4:
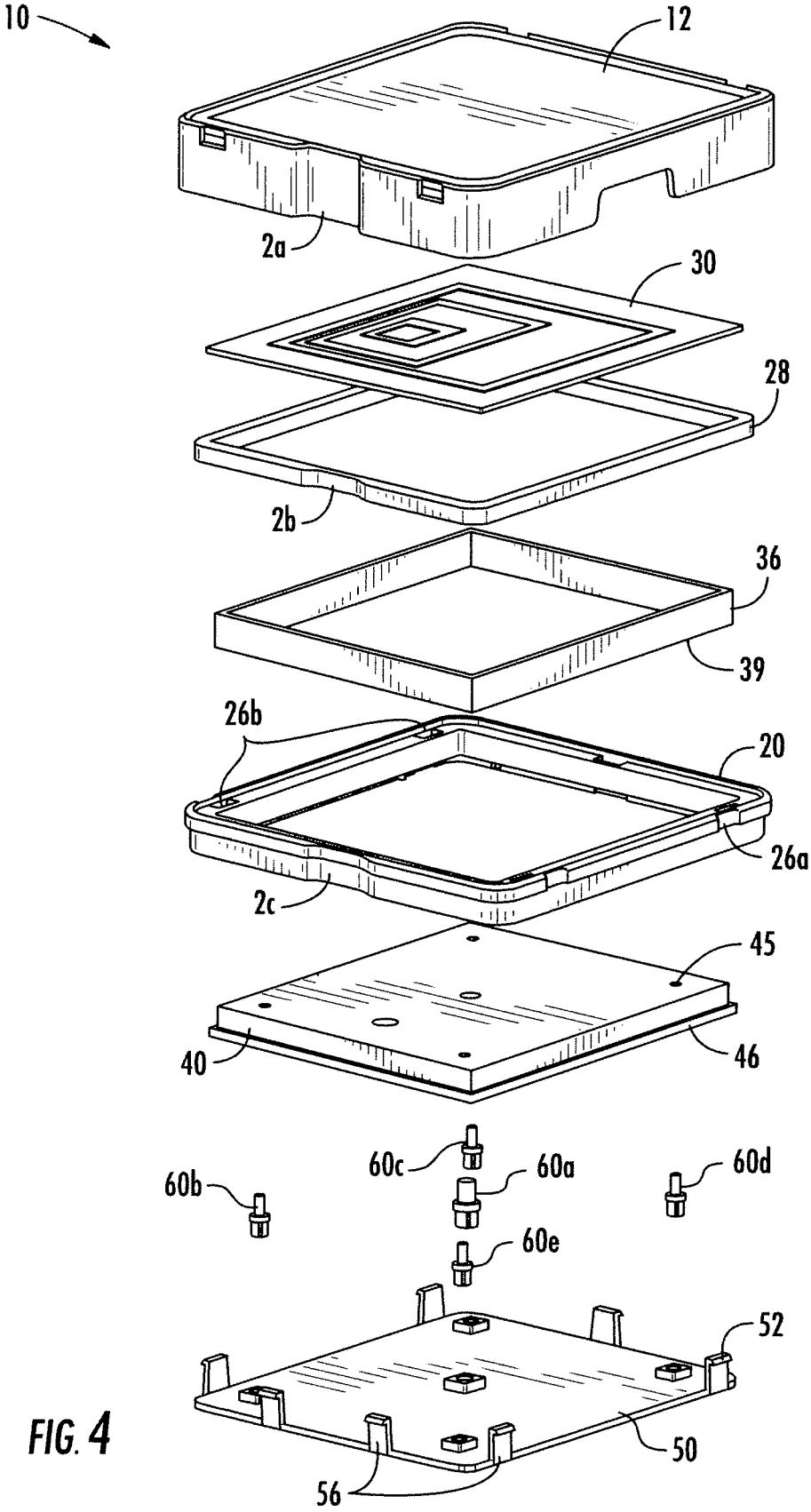
FIG. 4 is an exploded view of the die assembly with cover of FIG. 1.

The cover 12 may include the lugs 19, which extend inwardly from the sidewall 16 and are configured to engage the lip 24 of the outer support 20, thereby releasably coupling (e.g., snap fit) the outer support 20 to the cover 12 when the cover 12 is in the closed position. When the cover 12 is in the inking position, the lugs 19 pass through the recesses 26*a* and 26*b* of the lip 24 and, therefore, do not snap to the lip 24, facilitating removal of the die assembly 10 from the cover 12 after inking. Referring to FIG. 4, the cover 12, the ejection material 28, and the outer support 20 each contain a feature, shown as the indents 2*a*-2*c*, which prevents the cover 12 from being oriented such that the lugs 19 engage the lip 24 in the second cover position.

The cover 12 may include one or more structures, shown as the protrusions 17, which extend inward from the inner surface 15. Alternatively, the protrusions 17 may extend outward from the outer surface 14. The protrusions 17 are configured to pass at least partially through the opening 54 of the base 50 and engage (e.g., lift, interface with, force, etc.) the bottom end 54 of the pin 60 when the cover 12 is in the inking position. For example, a diameter of the protrusion 17 is less than a diameter of the opening 54. Further, the protrusion 17 is configured such that the protrusion 17 does not contact the debossing plate 30 when the cover 12 is in the closed position but can raise the pin 60 above the upper surface 42 when the cover 12 is in the inking position.

According to an exemplary embodiment, the cover 12, the outer support 20, the inner support 40, and the base 50 are formed from injection molded plastic. Alternatively, these components may each be formed from the same or different materials (e.g., metal, ceramic, composite, plywood, fiberboard, etc.) using any suitable process (e.g., die cast, stamped, welded, etc.).

Figure 3A:
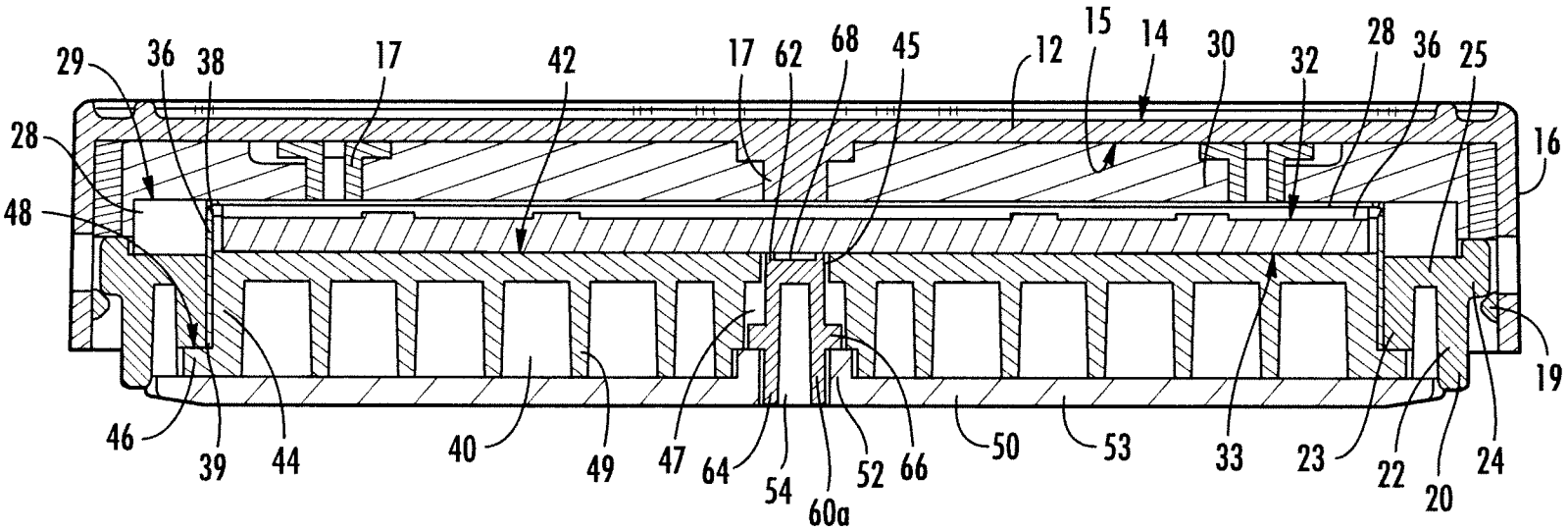
FIG. 3A is a cross-section view of the die assembly of FIG. 1.
Figure 3B:
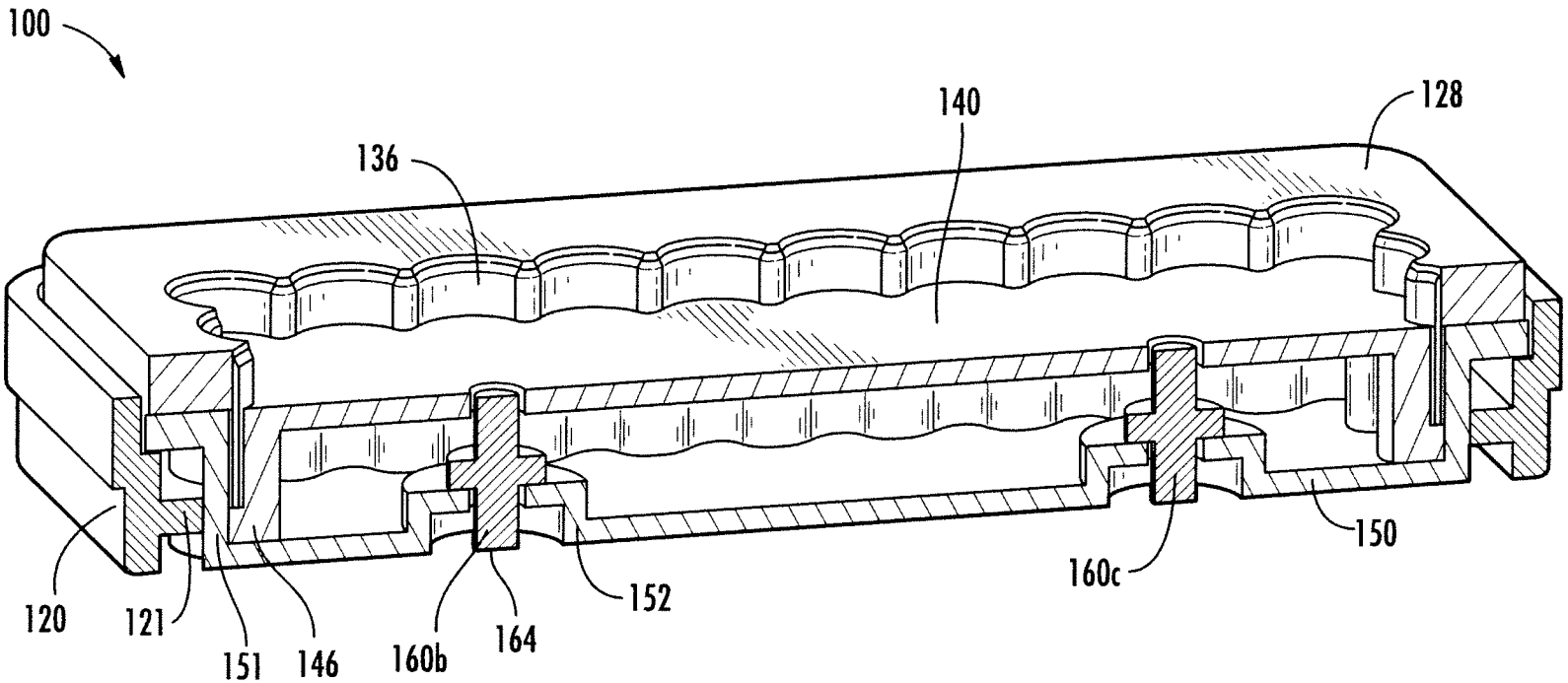
FIG. 3B is a cross-section view of a die assembly, according to another exemplary embodiment.

Referring to FIG. 3B, a cross-section of a the die assembly 100 is shown according to an exemplary embodiment. The die assembly 100 includes a first support 140, a second support 150, a third support 120, and a rule 136. The die assembly 100 may further include a debossing plate. As with the die assembly 10, the rule 136 is supported by a flange 146 extending from first support 140; however, the rule 136 is compression fit between the first support 140 and an upwardly extending sidewall 151 of the second support 150. Alternatively, the first support 140 and the second support 150 may be spaced apart to compensate for variations in the rule 136 during assembly, in which case the rule 136 may be adhered or press fit to the first support 140. The rule 136 is further shown to have a notched or wavy shape, to which the first support 140, the second support 150, and the ejection material 128 are substantially contoured.

The second support 150 may include one or more structures 152 and may be configured such that the bottom end 164 of the pin 160 extends below a lower wall of the second support 150 but remains within the height of the die assembly 100. The second support 150 may further include one or more tabs configured to couple the second support 150 to a third support 120. The third support 120 includes an open bottom and an inner flange 121 contoured to the notch or wavy shape of the outer perimeter of the sidewall 151 of the second support 150. The contoured flange 121 is configured to prevent deformation to the second support 150 during the cutting process.

Figure 5:
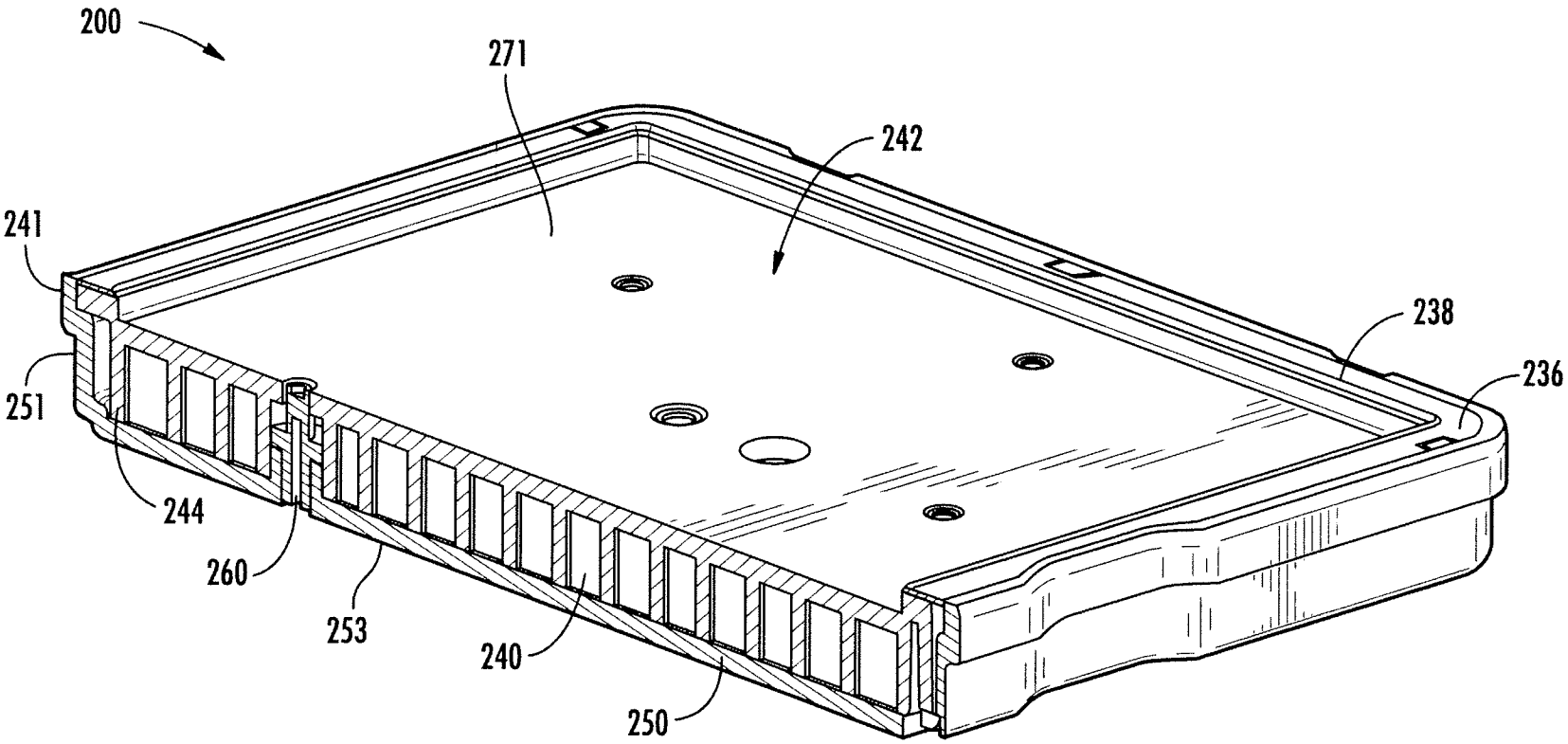
FIG. 5 is a cross-section view of a die assembly, according to another exemplary embodiment.
Figure 6A:
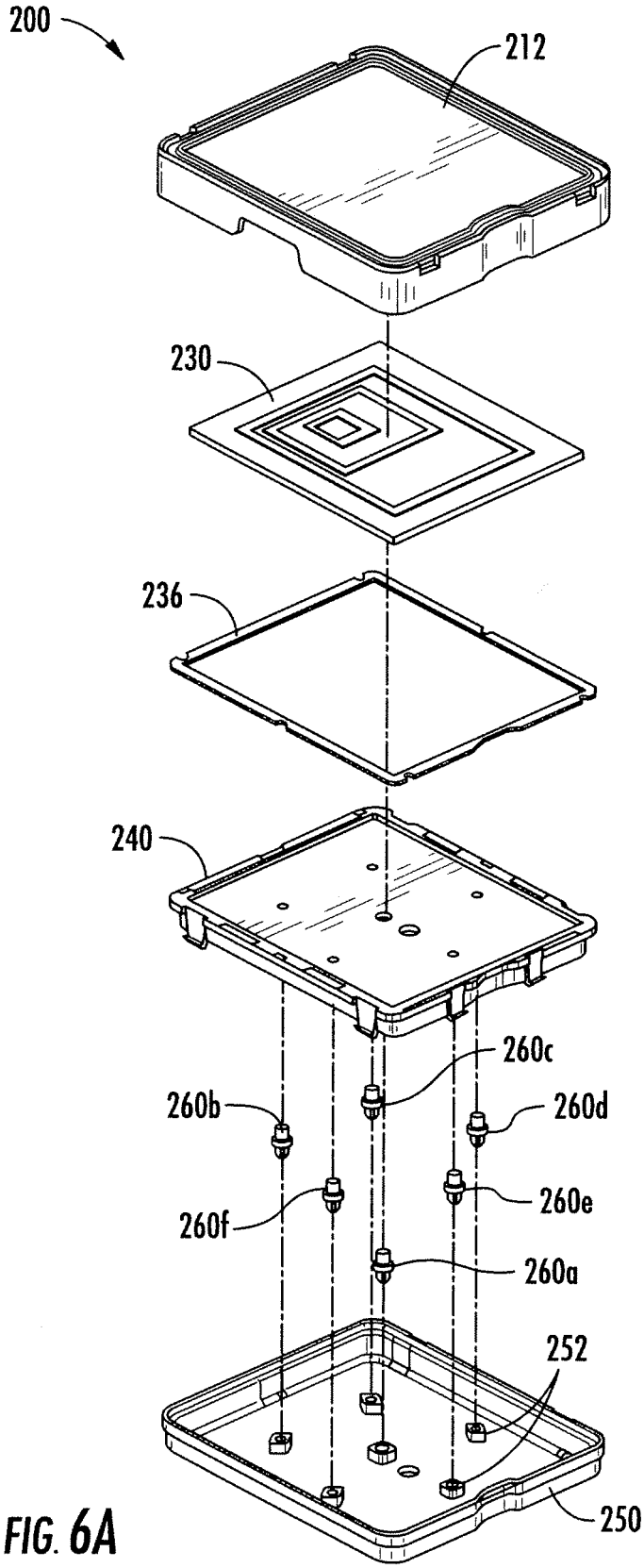
FIG. 6A is an exploded view of the die assembly with cover of FIG. 6.

Referring to FIGS. 5 and 6A, a die assembly 200 is shown according to an exemplary embodiment. The die assembly 200 includes a first support 240, a second support 250, and a cutting blade, shown as the chemically etched blade 236. As with the die assembly 10, the first support 240 includes an upper surface 242; however, the sidewall 244 extends upwardly to support an outwardly extending flange 241. The flange 241 substantially forms an upper perimeter of the first support 240 and cooperates with the upper surface 242 to define a recess 271. The recess 271 may be configured to receive a debossing plate. The flange 241 further includes an upper surface which supports the chemically etched blade 236, which has a cutting edge 238.

The second support 250 is shown to have a bottom wall 253, through which the pin 260 at least partially extends, and an upwardly extending sidewall 251. The sidewall 251 follows an outer perimeter of the first support 240 and is configured to prevent the first support 240 from deforming during the cutting and debossing processes. The sidewall 251 further provides the aesthetic benefit of concealing the first support 240 and the functional benefit of at least partially supporting the cantilevered portion of the flange 241 during the cutting process.

Figure 6B:
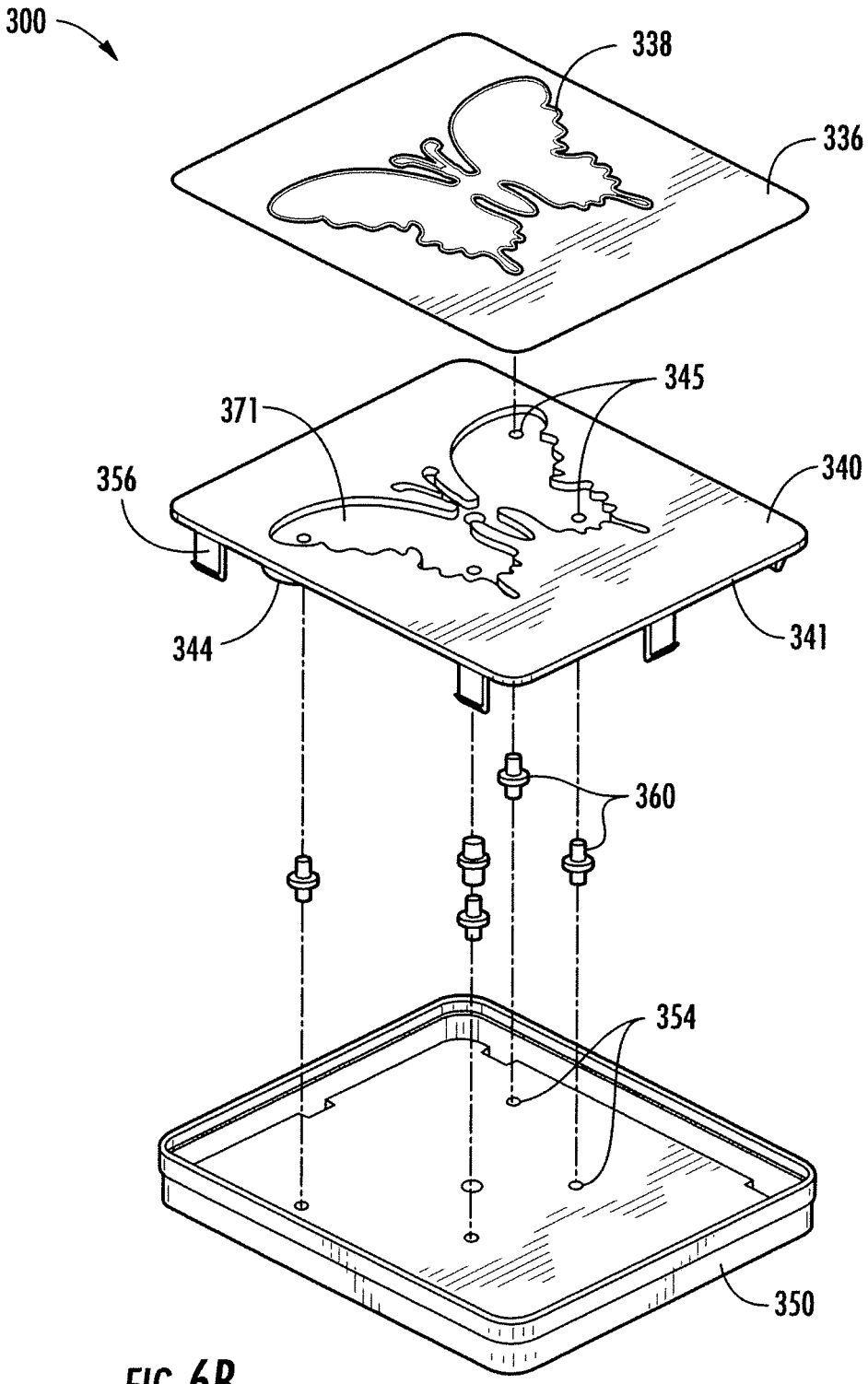
FIG. 6B is an exploded view of a die assembly, according to another exemplary embodiment.

Referring to FIG. 6B, a die assembly 300 is shown according to an exemplary embodiment. The die assembly 300 includes a first support 340, a second support 350, and a chemically etched blade 336. As shown, a chemically etched blade enables a more intricate cutting pattern than a rule; however, the cutting edge 338 is not as deep as would be with a rule. Accordingly, a rule may be preferred when cutting thicker materials, e.g., chip board, paper board, or the back of a notebook; however, a chemically etched blade may be preferred when cutting intricate patterns from craft paper.

Further, since the compression forces during the cutting and pressing processes are mainly transferred through the cutting edge 338 and a debossing plate located in the recess 371, the sidewall 344 of the first support 340 may be configured to follow the shape of the blade 336. This saves materials and reduces cost during manufacturing. Further, the pins 360 are located to actuate the debossing plate, thereby influencing the location of the openings 345 in the first support 340 and the openings 354 in the second support 350.

Figure 7:
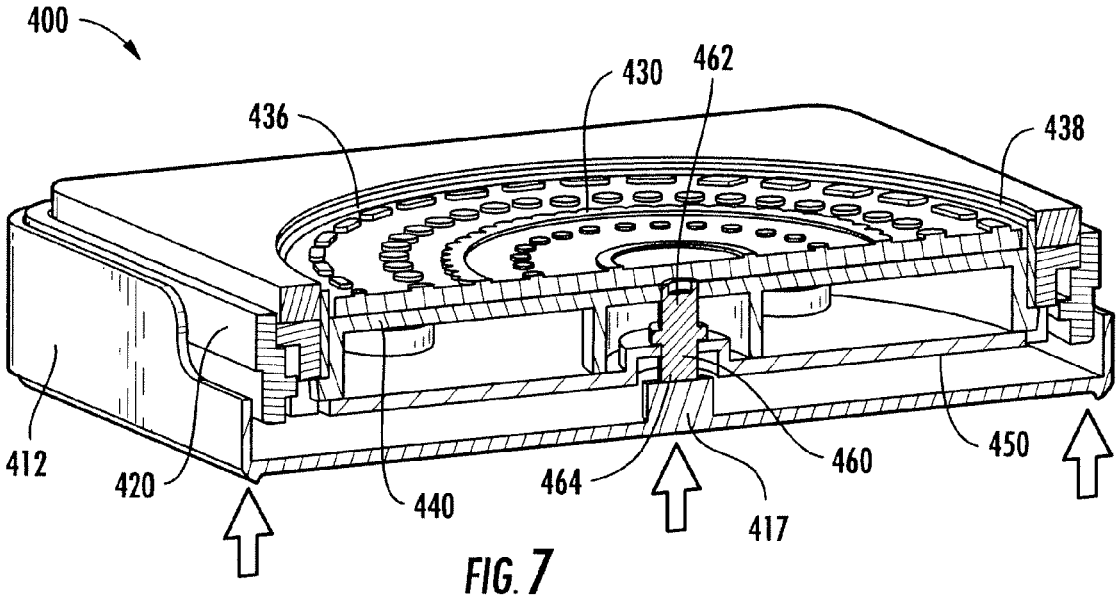
FIG. 7 is a cross-section view of a die assembly, according to another exemplary embodiment.
Figure 8:
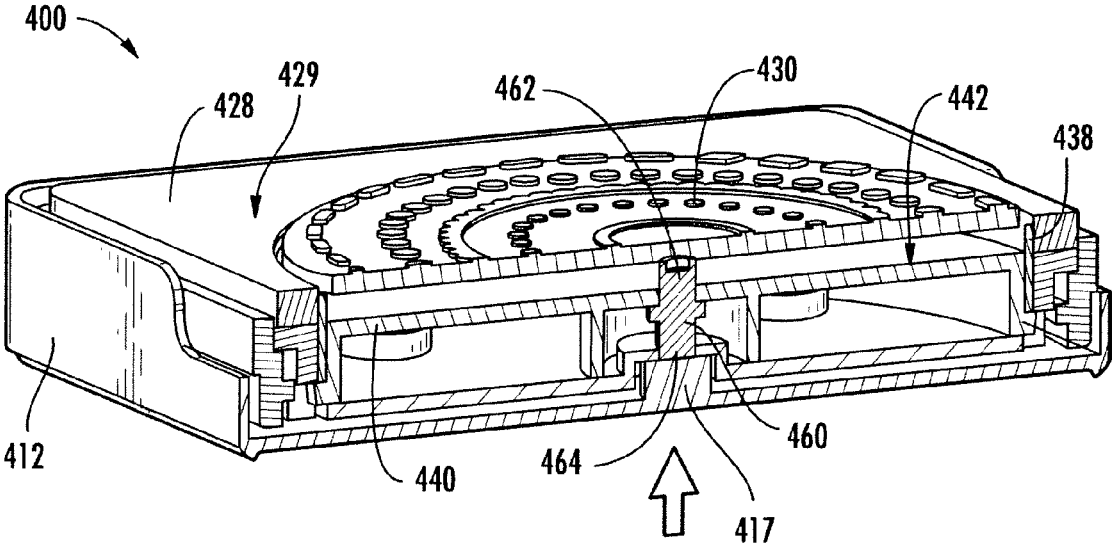
FIG. 8 is a cross-section view of the die assembly of FIG. 7 in another position.
Figure 9:
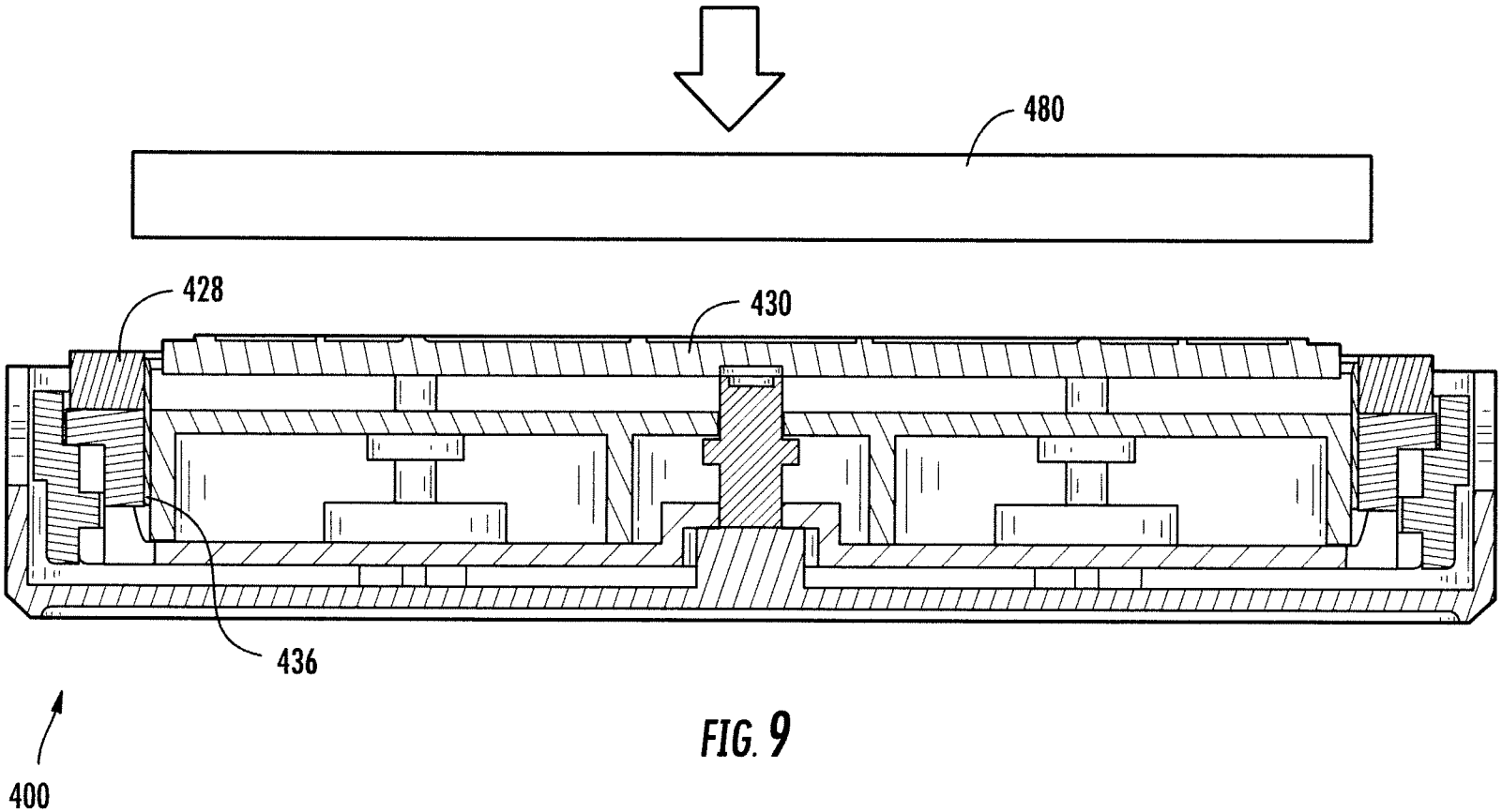
FIG. 9 is a cross-section view of the die assembly of FIG. 7 in another position.

Referring to FIGS. 7-9, a die assembly 400 is shown according to an exemplary embodiment. The die assembly 400 includes a first support 440, a second support 450, a third support 420, the debossing plate 430, and a rule 436. FIG. 7 is shown with the pin 460 in a first pin position (e.g., minimum height position, lowered position, press position, etc.) and the cover 412 between the first cover position and the second cover position. FIGS. 8 and 9 are shown with the pin 460 in a second pin position (e.g., maximum height position, raised position, inking position, etc.) and the cover 412 in the second cover position. The pin 460 is configured to move between the first pin position and the second pin position. The pin 460 may be configured to move from the first pin position to the second pin position in response to a force applied to the second end 464 and to return to the first position when the applied force is removed. For example, the applied force may be caused by the protrusion 417 in response to the cover 412 moving to and from the second cover position.

Referring to the embodiment shown in FIG. 7, when the pin 460 is in the first position, the first end 462 of the pin 460 is flush with or below the upper surface 442 of the first support 440, and the debossing plate 430 is at least partially supported by the upper surface 442. When the pin 460 is in the first pin position, the top surface 432 of the debossing plate 320 is below the cutting edge 438 of the rule 436 and the upper surface 429 of the ejection material 428. That is, the distances from the cutting edge 438 to the upper surface 442 of the first support 440 and from the upper surface 429 of the ejection material 428 to the upper surface 442 are greater than the distance from the top surface 432 of the debossing plate 430 to the upper surface 442 of the first support 440.

Referring to FIGS. 8 and 9, when the pin 460 is in the second position, the first end 462 of the pin 460 extends above the upper surface 442 of the first support 440, and the debossing plate 430 is supported by the pin(s) 460. When the pin 460 is in the second pin position, the top surface 432 of the debossing plate 320 is raised above the cutting edge 438 of the rule 436 and the upper surface 429 of the ejection material 428. That is, the distances from the cutting edge 438 of the rule 436 to the upper surface 442 of the first support 440 and from the upper surface 429 of the ejection material 428 to the upper surface 442 are less than the distance from the top surface 432 of the debossing plate 430 to the upper surface 442 of the first support 440. As shown in FIG. 9, raising the debossing plate 430 facilitates applying ink to the debossing plate 430 without applying ink to the rule 436 or the ejection material 428. Raising the debossing plate 430 further facilitates removing the cut shape from the die and facilitates removing the debossing plate 430 from the die assembly 400, for example, for cleaning, repair, or replacement.

In addition to the embodiments described above, various other modifications and embodiments are contemplated. For example, the die assembly may include multiple blades or one or more nested blade patterns, and the debossing pattern can be separated into multiple pieces or be located outside of the cutting blade. The ejector pin interface can provide multiple configurations to allow these separate debossing plates to be inked separately as well.

The steel rule dies may be formed in several ways that hold the steel rule with varying levels of quality, and all steel rule die designs may be modified to provide a surface below the cutting blade height to seat a debossing plate, and can also be modified to create a means for ejecting, or raising the debossing plate.

The ejector pins can be integrated into most variations of press based cutting die including dies that are installed into or onto rollers or dies that utilize other types of cutting blades to provide a repeatable debossed, inked image that is cut in the same pass that the ink is applied.

The system according to various embodiments allows for the combination of the processes of ink application, debossing, and cutting. The debossing component may be used separately from the cutting die to deboss a pattern in combination with the roller press mechanism. In addition, ink can be applied to the debossing plate and used as a stamp without creating a debossed surface. The cutting die may be used without the debossing plate as well, allowing all three processes to be separated. The debossing plate may be used without the cutting die to simultaneously deboss and apply ink. The debossing plate may be used without ink, and placed within the cutting die to simultaneously deboss and cut. The cutting die may cut out the die pattern, and combined with the secondary operation of using the debossing plate as a stamp to cut and apply ink to the pattern. This allows any combination of two of the three processes to be used with a maximum of two processes.

Figure 10:
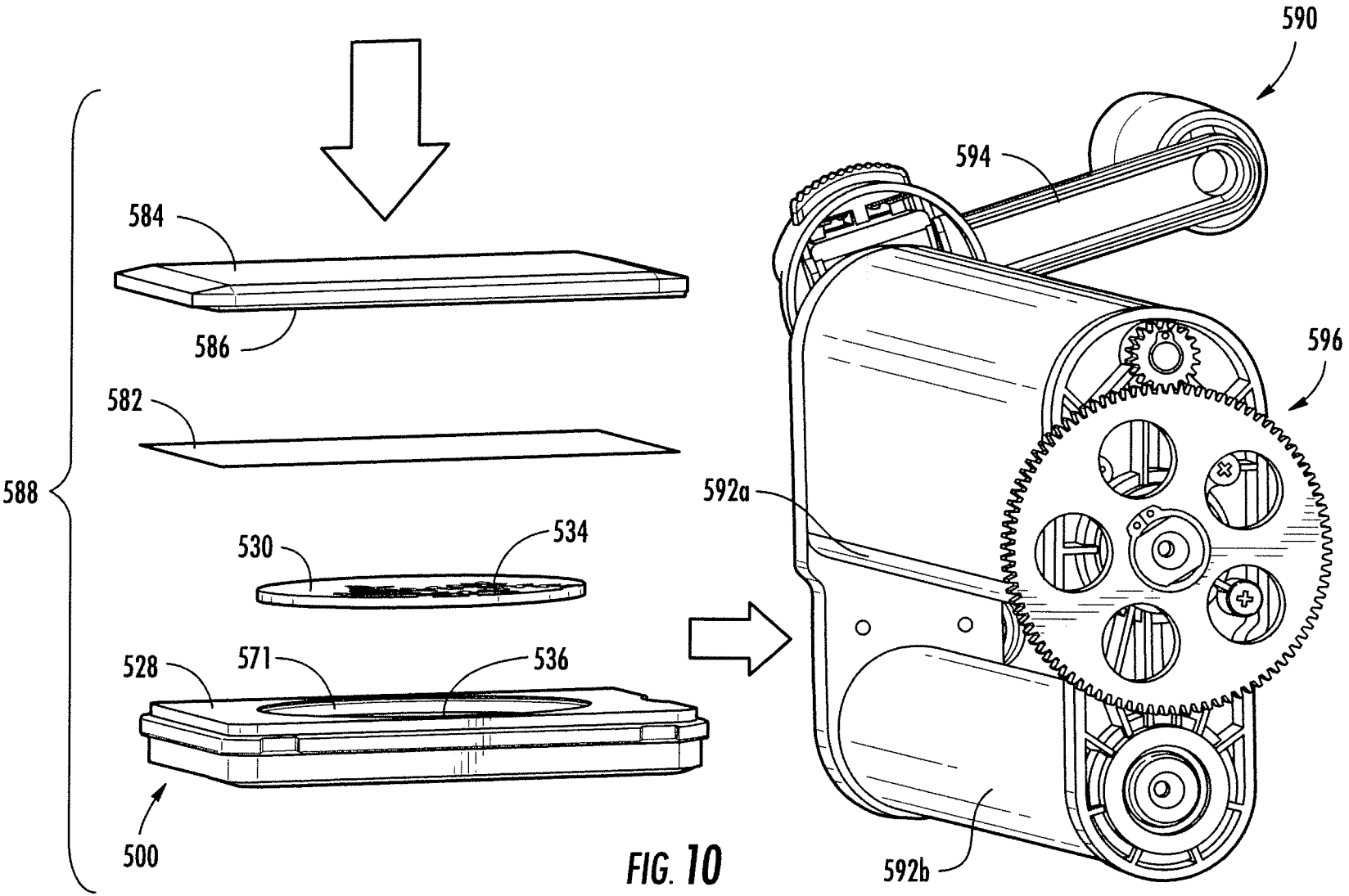
FIG. 10 is a perspective view of a die assembly and components of a press, according to another exemplary embodiment.

Referring to FIG. 10, internal components of a press 590 and a die assembly 500 are shown according to an exemplary embodiment. It should be noted that, for the sake of clarity, a plate 530 is shown exploded out of the die 500, and the external components of press 590 have been removed. While any suitable press may be used, the press 590 is shown to be a roller press including one or more rollers 592*a*-592*b* (referred to generally as 592 herein). The press 590 may be motorized, or may include a handle or crank 594 configured to enable manual operation of the press 590 via transmission 596.

The die assembly 500 is shown to include an ejection member 528, a plate 530, and a rule 536. A sheet material 582 is placed between the die 500 and a cutting plate 584. The cutting plate 584 is a sacrificial surface, typically in the form of a transparent or translucent plastic material, but may be of any suitable material.

According to the embodiment shown, the sheet material 582 is placed on the die 500, and the cutting plate 584 is placed on the sheet material 582 such that the debossing mat 586 is adjacent the sheet material. The die 500, the debossing plate 530, the sheet material 582, and the cutting plate 584 can be referred to as a sandwich or a stack 588. According to an alternative embodiment, the stack 588 may be inverted such that the sheet material 582 is placed on the cutting plate 584, and the die 500 is placed on the sheet material 582 with the debossing plate 530 and the rule 536 facing down.

The overall thickness of the die 500 and the cutting plate 584 is greater than the distance between rollers 592 of a press 590. Accordingly, when the stack 588 is compressed by the press 590, the cutting edge 538 of rule 536 presses (e.g., cuts, passes, etc.) through the sheet material 582 and into the cutting plate 584.

After the stack 588 has passed through press 590, the plate 530 may be used to eject the cut shape from the die 500. For example, the plate 530 may be an ejection plate configured to raise the cut shape above the rule 536 and ejection material 528 when a pin 560 moves from a retracted position to an extended position. Moving the pin 560 from the retracted position to the extended position may be accomplished using protrusions on an inner surface of a die cover as described with reference to FIGS. 7-9.

In order to create a cutting die 500 that also creates a debossed pattern with ink pressed into the debossed pattern, at least a portion of the ejection material 528 is removed from inside the cutting pattern (e.g., blade 538) and a debossing plate 530 is placed in the opening 571. The raised pattern 534 on the debossing plate 530 is set below the height of the cutting edge 538 of the rule 536, allowing sufficient pressure to press the pattern into the sheet material 582 to a desired depth, but not enough to prevent cutting of the sheet material 582 in a single pass through the press 590. Ink may be applied to the raised pattern 534 on the debossing plate 530 and is transferred to the sheet material 582 during the cutting and debossing process.

In order for the debossing plate 530 to create the desired depth of image in standard scrapbooking or craft paper, a standard cutting plate may be insufficient. A debossing mat 586 may be added between the cutting plate 584 and the sheet material 582. The debossing mat 586 may be coupled to or distinct from cutting plate 584. The debossing mat 586 includes a resilient surface of a desired thickness and durometer, which allows the sheet material 582 to deform and create a deeper pattern without requiring an opposite matching pattern of the raised pattern 534 on the debossing plate 530 to be located above the sheet material 582. Accordingly, the debossed image may be pressed deeper into the sheet material while still permitting the entirety of the desired cutting pattern to be cut.

According to another embodiment, the debossing plate 530 can be used with the cutting plate 584 and the debossing mat 586 but without the cutting blade 536 in a process that is similar to letter pressing. When the resulting stack is used with the press 590, a desired pattern from the debossing plate 530 is pressed into a thick craft material 582, causing a debossed image on the craft material 582 with ink filling the depression.

This die cutting system may be modified for use in low to medium volume mass production, for example, with a vertical press, integrated interface of the ejector pins, and ink application integrated by a fixed height roller that passes when the press is opened.

Referring to FIGS. 3A and 4, a method of assembling the die assembly 10 is described according to an exemplary embodiment. The rule 36 is laid on the inner support 40 with the bottom end 39 of the rule 36 supported by the lip 46 of the inner support 40. The rule 36 and the inner support 40 are placed into the outer support 20. The inner support 40 and the outer support 20 hold the rule 36 in place with a compression fit. Alternatively, the rule 36 may be press fit or adhered to either the inner support 40 or the outer support 20. One or more pins 60 are placed into the cavity(s) 47 in the inner support 40, and the base 50 is coupled to the outer support 20. The ejection material 28 is coupled (e.g., glued, fastened, etc.) to an upper surface of the outer support 20. The debossing plate 30 may be placed onto the inner support 40. The cover 12 may then be coupled to the die assembly 10. It should be understood that the processes described above may be performed in various orders, or that processes may be added or omitted. For example, in the case in which dies are sold separately from debossing plates, the debossing plate 30 may not be placed onto the inner support 40. Other modifications are contemplated. For example, the pins 60 may be placed into the holes 54 of the base 50, the base 50 then being coupled to the outer support 20. Further processes may be added or deleted to modify the assembly process for embodiments described as the die assemblies 100, 200, 300, and 400.

Figure 11:
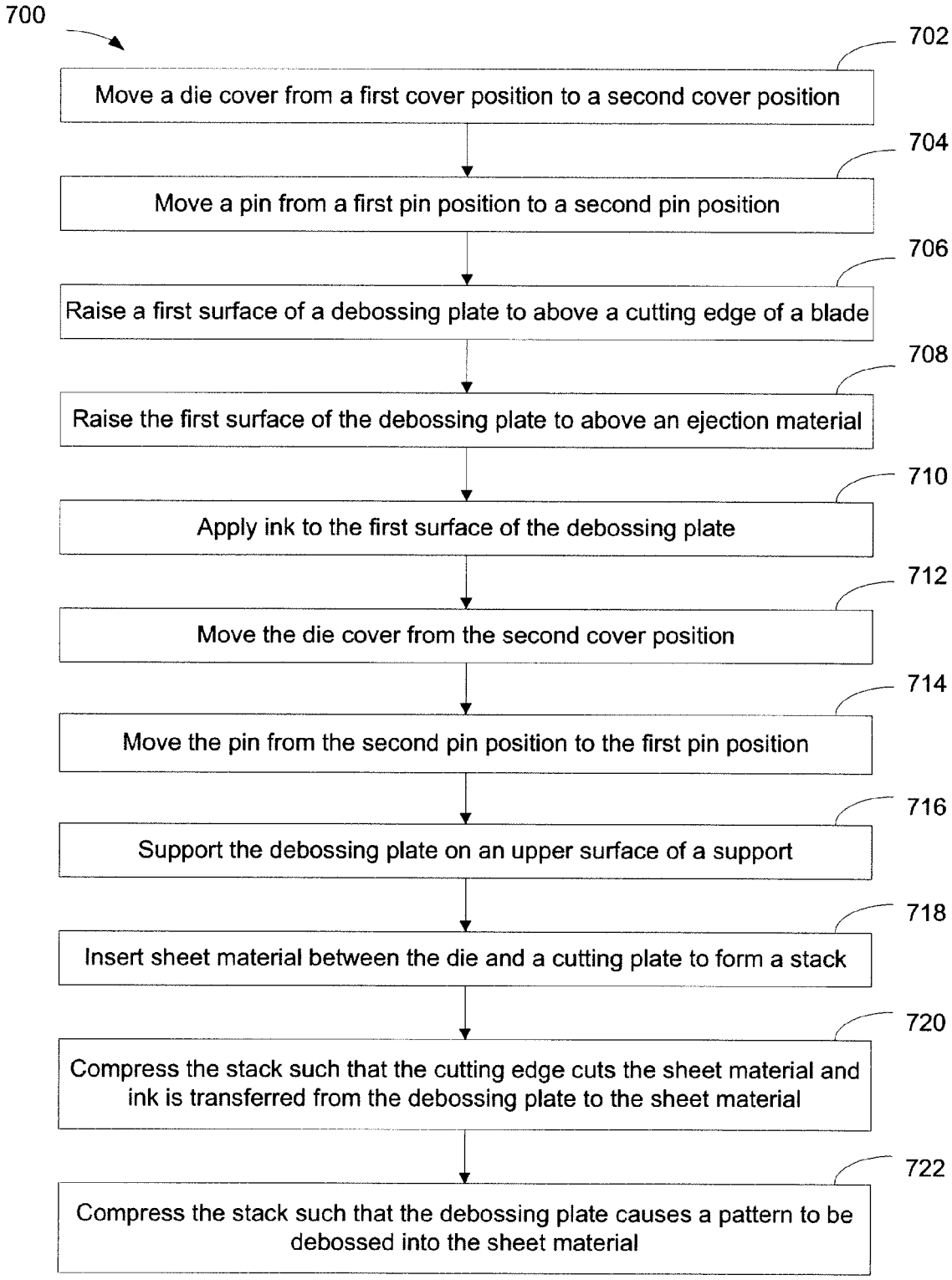
FIG. 11 is a schematic flow chart of a method of using a die cutting system, according to an exemplary embodiment.

Referring to FIG. 11, a flowchart of process 700 for using a die cutting system is described according to an exemplary embodiment. The process 700 is shown to include the processes of moving a die from a first cover position to a second cover position (process 702). For example, the cover 12 may be removed from the closed position on the die assembly 10 and moved underneath the die assembly 10 to the inking position. Alternatively, the cover 12 may be moved from any position, such as a set-aside position between inkings, to the second cover position. The process 700 may further include the processes of moving a pin from a first pin position to a second pin position (process 704), raising a first surface of a debossing plate to above a cutting edge of a blade (process 706), and raising the first surface of the debossing plate to above an ejection material (process 708). It is contemplated that these processes may be performed simultaneously with, or in rapid succession of, the process 702. For example, moving the cover to the second position (process 702) may cause the pins to move (process 704), which in turn raises the debossing plate past the cutting edge and ejection material (processes 706 and 708). Ink may then be applied to the first surface of the debossing plate (process 710).

The process 700 is further shown to include the processes of moving die cover from the second position (process 712), moving the pin from the second pin position to the first pin position (process 714), and support the debossing plate on an upper surface of a support (process 716). Process 712 may include moving the cover 12 to the closed cover position or to a set-aside position. Processes 714 and 716 may happen simultaneously with, or in rapid succession of, the process 712. That is the process 712 may cause processes 714 and 716.

A stack may then be formed by inserting a sheet material between the die and a cutting plate (process 718). The stack may then be compressed such that the cutting edge cuts the sheet material and ink is transferred from the debossing plate to the sheet material (process 720) and the debossing plate causes a pattern to be debossed into the sheet material (process 722).

Alternate embodiments of the process 700 are contemplated. Processes may be performed in various orders or may be omitted. For example, the processes 702 and 712 may be omitted if the pins 60 are not raised by the protrusions 17 on the cover 12, e.g., if an automated press uses probes to actuate the pins 60; the process 708 may be omitted for chemically etched blade die assemblies which do not include an ejection material (e.g., die assemblies 200 and 300); processes 702-714 may be omitted if ink is not desired; or the stacking and pressing processes 718-722 may be omitted. Additional processes may also be added. For example, a debossing mat may be added to the stack between the sheet material and the cutting plate.

It is also important to note that the construction and arrangement of the elements of the system and die as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The order or sequence of any processes may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. A system for cutting, inking, and debossing sheet material located between a die and a cutting plate, the system comprising:

a die including:

a support defining an opening;

a blade positioned adjacent to the support and defining a cutting edge;

a debossing plate configured to cause one or more indentations in the sheet material and comprising an obverse side and a reverse side located substantially opposite the obverse side, the obverse side having a raised pattern defined thereon; and at least one pin configured to extend through the opening in the support and to move between a first position and a second position;

wherein when the at least one pin is in the first position, the debossing plate is supported by the support, and wherein when the at least one pin is in the second position, the reverse side of the debossing plate is supported by the at least one pin.

2. The system of claim 1 further comprising a debossing mat located adjacent the cutting plate, the debossing mat configured to resiliently conform to the raised pattern of the debossing plate.

3. The system of claim 1, wherein the blade comprises a chemically etched blade coupled to an upper surface of the support.

4. The system of claim 1, wherein the support comprises a sidewall and an outwardly extending flange having an upper surface, and wherein the blade comprises a steel rule at least partially supported by the upper surface of the flange.

5. The system of claim 1 further comprising an ejection member adjacent a cutting edge of the blade, the ejection member configured to resiliently compress from a height greater than the cutting edge of the blade to a height less than the cutting edge of the blade.

6. The system of claim 5, wherein the ejection member comprises a resilient foam.

7. A system for cutting, inking, and debossing sheet material located between a die and a cutting plate, the system comprising:

a die including:

a support defining an opening;

a blade positioned adjacent to the support and defining a cutting edge;

an ejection member adjacent a cutting edge of the blade, the ejection member configured to resiliently compress from a height greater than the cutting edge of the blade to a height less than the cutting edge of the blade;

a debossing plate configured to cause one or more indentations in the sheet material and comprising a first side and a second side located substantially opposite the first side, the first side having a raised pattern defined thereon; and at least one pin configured to extend through the opening in the support and to move between a first position and a second position;

wherein when the at least one pin is in the first position, the debossing plate is supported by the support, and wherein when the at least one pin is in the second position, the second side of the debossing plate is supported by the at least one pin;

wherein when the at least one pin is in the first position, the first side of the debossing plate is below the height of the cutting edge of the blade, and when the at least one pin is in the second position, the first side of the debossing plate extends above the ejection member.

8. The system of claim 1, wherein the at least one pin is coupled to the second side of the debossing plate.

9. The system of claim 1 further comprising a press configured to force the cutting plate against the die, thereby cutting the sheet material located therebetween.

10. A die for cutting and debossing sheet material, comprising:

a first support including an upper surface and defining an opening extending through the first support;

a debossing plate configured to cause one or more indentations in the sheet material and comprising a first side having a raised pattern defined thereon and a second side located substantially opposite the first side, the second side positioned adjacent the upper surface of the first support;

a blade coupled to the first support and defining a cutting edge; and a pin including a first end and a second end, the first end extending at least partially through the opening defined in the first support;

wherein the pin is configured to move between a first pin position and a second pin position, wherein when the pin is in the first pin position, the first end of the pin is below the upper surface of the first support, and wherein when the pin is in the second pin position the first end of the pin extends above the upper surface of the first support, thereby lifting the debossing plate from the first support.

11. The die of claim 10 further comprising a second support coupled to the first support and defining an opening extending through the second support, the first support and second support defining a cavity, wherein the pin is located at least partially within the cavity and the second end of the pin at least partially extends through the hole in the second support.

12. A die for cutting and debossing sheet material, comprising:

a first support including an upper surface and defining an opening extending through the first support;

a debossing plate configured to cause one or more indentations in the sheet material and comprising a first side having a raised pattern defined thereon and a second side located substantially opposite the first side, the second side positioned adjacent the upper surface of the first support;

a blade coupled to the first support and defining a cutting edge;

a pin including a first end and a second end, the first end extending at least partially through the opening defined in the first support, wherein the pin is configured to move between a first pin position and a second pin position, wherein when the pin is in the first pin position, the first end of the pin is below the upper surface of the first support, and wherein when the pin is in the second pin position the first end of the pin extends above the upper surface of the first support;

a second support coupled to the first support and defining an opening extending through the second support, the first support and second support defining a cavity, wherein the pin is located at least partially within the cavity and the second end of the pin at least partially extends through the hole in the second support; and a cover including a protrusion extending therefrom, the cover configured to move between a first cover position and a second cover position, wherein when the cover is in the first cover position, the cover is located substantially opposite the first support from the second support, and wherein when the cover is in the second cover position the cover is located substantially opposite the second support from the first support, and wherein the protrusion is configured to engage the second end of the pin such that when the cover is in the second cover position, the pin is in the second pin position.

13. The die of claim 12, wherein the cover comprises an inner surface and an outer surface, and wherein the protrusion extends inwardly from the inner surface of the cover.

14. The die of claim 12, further comprising a third support coupled to the second support, wherein the cover is configured to releasably couple to the third support when the cover is in the first cover position, and wherein the blade is compression fit between the first support and one of the second support and the third support.

15. The die of claim 10, wherein when the pin is in the second position, the raised pattern of the debossing plate is above the cutting edge such that the raised pattern may receive ink.

16. The die of claim 10, wherein when the pin is in the first pin position, the distance from the cutting edge of the blade to the upper surface of the first support is greater than the distance from the first side of the plate to the upper surface of the first support, and wherein when the pin is in the second pin position, the distance from the cutting edge of the blade to the upper surface of the first support is less than the distance from the first side of the plate to the to the upper surface of the first support.

17. A die for cutting sheet material, comprising:

a support defining an opening;

a blade positioned adjacent to the support and defining a cutting edge;

at least one pin configured to extend through the opening in the support and to move between a retracted position and an extended position; and an ejection plate configured to eject the cut shape from the die when the at least one pin moves from the retracted position to the extended position.

18. The die of claim 17, wherein the ejection plate comprises a raised pattern configured to deboss one or more indentations in the sheet material.

19. The die of claim 18, wherein when the pin is in the extended position, the raised pattern of the ejection plate is above the cutting edge such that the raised pattern may receive ink.

20. The die of claim 17, wherein the die is configured such that when the sheet material is pressed against the die, the die substantially simultaneously cuts, debosses, and inks the sheet material.

21. The die of claim 17, wherein:

the support comprises an upper surface;

the ejection plate is configured to normally rest upon the surface of the support; and when the at least one pin moves from the retracted position to the extended position, the at least one pin lifts the ejection plate from the support.

* * * * *